US006719370B2

(12) United States Patent
Hannon et al.

(10) Patent No.: US 6,719,370 B2
(45) Date of Patent: Apr. 13, 2004

(54) STADIUM SEAT

(75) Inventors: Kevin Michael Hannon, Blaxland (AU); Philip Duncan Loader, Kearns (AU)

(73) Assignee: Viscount Plastics (NSW) Ltd., New South Wales (AU)

( * ) Notice: Subject to any disclaimer, the term of this patent is extended or adjusted under 35 U.S.C. 154(b) by 0 days.

(21) Appl. No.: 10/098,180

(22) Filed: Mar. 15, 2002

(65) Prior Publication Data

US 2003/0047976 A1 Mar. 13, 2003

(30) Foreign Application Priority Data

Sep. 11, 2001 (AU) ..... PR7610
Dec. 11, 2001 (AU) ..... PR9433

(51) Int. Cl.[7] ..... A47C 1/02

(52) U.S. Cl. ..... 297/331; 297/335; 297/332; 267/133

(58) Field of Search ..... 297/440.15, 440.16, 297/DIG. 2, 331, 332, 335, 440.17, 333, 336; 367/133, 131

(56) References Cited

U.S. PATENT DOCUMENTS 3,572,826 A * 3/1971 Barnes ..... 297/249
3,589,762 A * 6/1971 Henrikson ..... 297/324
3,762,765 A * 10/1973 Piretti ..... 297/162
5,195,802 A * 3/1993 Hayakawa et al. ..... 297/335
5,320,411 A * 6/1994 Sera ..... 297/335
5,601,335 A * 2/1997 Woods et al. ..... 297/301.3
5,601,338 A * 2/1997 Wahls ..... 297/313
5,800,015 A * 9/1998 Tsuchiya et al. ..... 297/331
5,899,531 A * 5/1999 Koehler ..... 297/335
6,474,737 B1 * 11/2002 Canteleux et al. ..... 297/321

FOREIGN PATENT DOCUMENTS

DE 200 07 090 6/2000
EP 000580315 A1 * 6/1993
GB 2189682 A * 4/1986
JP 08-299094 11/1996
JP 11-123125 5/1999
JP 11-178669 7/1999
JP 11-225843 8/1999

* cited by examiner

*Primary Examiner*—Peter M. Cuomo
*Assistant Examiner*—Erika Garrett
(74) *Attorney, Agent, or Firm*—Nixon Peabody LLP; Jeffrey L. Costellia

(57) ABSTRACT

A tip-up seat assembly with a backrest, adapted to be secured to a supporting structure in a generally upright orientation, a corresponding seat member adjacent the backrest, hingedly mounted for rotation between an open position wherein the seat member is substantially horizontal and a folded position wherein the seat member is tilted upwardly toward the backrest, biasing device for biasing the seat member toward the folded position, and a tilt-limiter configured to resiliently restrain the seat member in an intermediate position thereby avoiding inadvertent rotation of the seat member into the folded position.

17 Claims, 19 Drawing Sheets

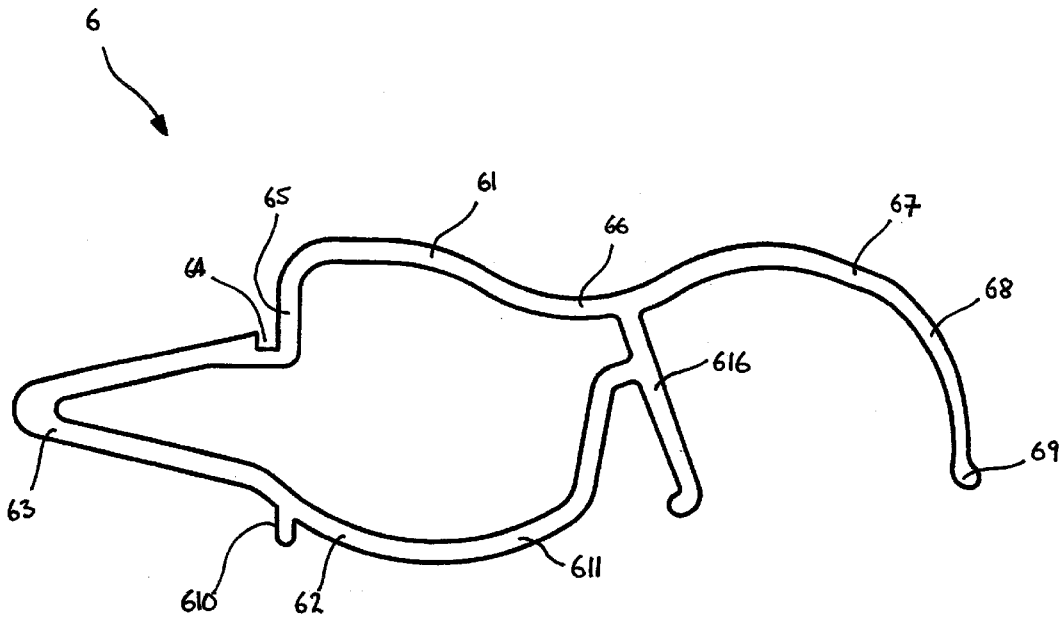
Figure 6c(i)
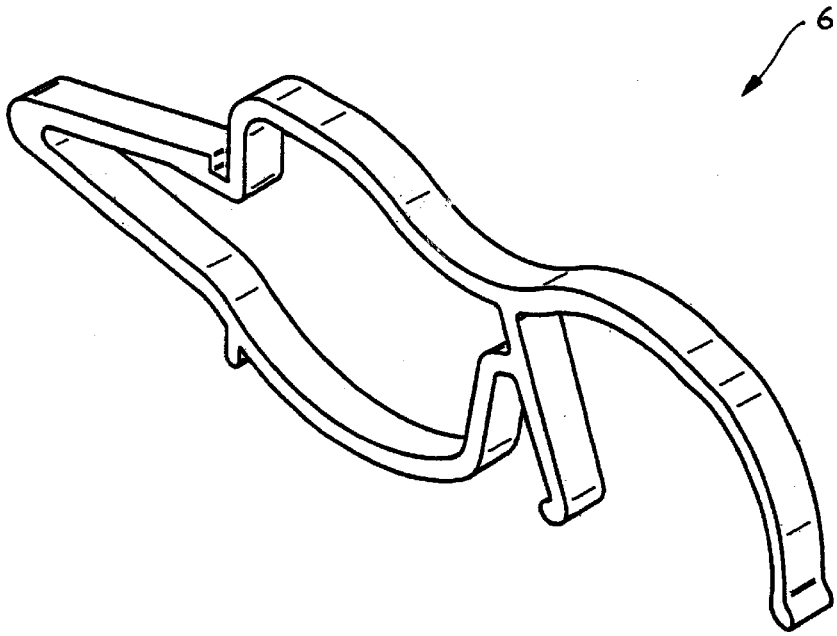
Figure 6c(ii)

STADIUM SEAT

TECHNICAL FIELD

The present invention relates generally to seats, chairs and the like, and more particularly to fold-up or "tip-up" seats.

DESCRIPTION OF THE PRIOR ART

The invention has been developed primarily for use as a stadium seat, and will be described predominantly with reference to this application. It will be appreciated, however, that the invention is not limited to this particular field of use, being also applicable to auditoriums, concert halls, opera houses, grandstands, theatres, cinemas and potentially any other situation in which fold-up or tip-up seating is employed.

Any discussion of the prior art throughout the specification should in no way be considered as an admission that such prior art is widely known or forms part of common general knowledge in the field.

Stadium seats are reasonably well known. They typically comprise a generally horizontally oriented seat member disposed to support the majority of the weight of a sitter, and a generally vertically oriented backrest positioned immediately behind and above the seat member to provide appropriate back support. While some stadiums make use of elongate bench type arrangements, these tend to become relatively uncomfortable after prolonged periods, and for this reason, individual seat configurations are generally preferred.

Individual stadium seats of this type are typically grouped together in rows and are normally anchored securely to a frame or other supporting structure so as to maintain the intended spacing between seats and prevent unauthorised removal.

One difficulty that is commonly encountered with such seating is that in order to accommodate the maximum number of spectators in a limited space, the seats must be positioned relatively closely together. Such constraints on packing density apply in terms of both the lateral spacing between adjacent seats in a row, and the fore and aft spacing between successive rows. This makes it difficult for spectators to move along the limited corridor space between the backs of the seats in one row and the fronts of the seats in the adjacent row. It also makes cleaning of the seats, and of the spaces beneath, around and between them, more difficult.

In an attempt to ameliorate these problems, so-called tip-up stadium seats have been developed. These seats typically incorporate some form of hinge mechanism to permit the seat member to fold or tip upwardly toward the backrest, thereby creating additional corridor space between adjacent rows when the seats are not in use. Arrangements of this type have permitted greater packing densities to be achieved, or alternatively have provided more comfortable spacing between rows for a given packing density. They have also enabled greater access to facilitate cleaning. However, known tip-up seat mechanisms have been found in practice to suffer from various disadvantages, deficiencies and problems.

For example, in some designs, the only stable rest position for the folding seat member is the operative or use position, so that the potential space saving can only be realised by a spectator manually tipping up each seat individually as they pass along the row. This is a clumsy, awkward and time-consuming procedure for a user attempting to move along a particular row for any significant distance.

In other designs, a counterweight mechanism is provided so as automatically to bias the seat member into a fully upright or retracted position, when not in use. This provides optimum space saving potential. However, arrangements of this type are also prone to problems and disadvantages. For example, it is not uncommon for the mechanism to become stiff over time, due to the accumulation of dirt, spilled food or drink and other debris in the relatively small clearance spaces associated with the hinges. As soon as the resultant friction exceeds the relatively small retraction force provided by the counterweight, the retraction mechanism fails to operate automatically, and the individual seat members must once again be manually raised.

Such designs are further limited in that they require the seat member to be manually folded down, against the retraction force provided by the counterweight, before the user can safely sit on it. This operation is inconvenient if the user's hands are otherwise occupied, for example in carrying bags, food, drink or other amenities.

There is also a safety concern in relation to seats of this type, in situations when the user stands and then attempts to resume the seated position. In such circumstances, if the user is unaware that the seat member has automatically tipped upwardly into the retracted position, there is a significant risk that the user will fall onto the ground in front of the retracted seat, landing directly on the user's coccyx. This gives rise to the concomitant risk of shock and potentially serious spinal injury. Spectators are particularly prone to this sort of accident when standing momentarily while their attention is drawn away from the seat, as occurs for example when spontaneously rising to applaud, cheer on a player or team, celebrate a point score, or perform a "Mexican wave".

In an attempt to ameliorate these problems, some tip-up stadium seats have been designed so as not to allow the seat member to retract into the fully upright position. However, this restriction compromises the space saving potential and also impedes cleaning and maintenance operations.

Many known stadium seats are also prone to rapid deterioration and premature failure due to inadequacies in their design and/or a failure on the part of the designers to anticipate the severity of the conditions to which the seats are repeatedly exposed at major mass marketed sporting events.

For example, in a number of known tip-up stadium seats, the hinge mechanisms have been found to be deficient. In some cases, the hinges are relatively weak, and are prone to rapid wear and frequent failure through the use and abuse to which they are inevitably subjected. Some designs are also susceptible to being improperly assembled at the installation stage, as a consequence of which the seat member can inadvertently become disconnected from the backrest and the supporting frame while in use. This situation is potentially hazardous, again due to the risk of the sitter falling without warning and landing on the coccyx.

A distinct but related shortcoming of some seats is that they can be disassembled too readily, and are therefore susceptible to vandalism. Aside from the cost of maintenance and repair, this issue is particularly problematic, because of the inherent hazard involved if the seat member can be intentionally removed and used abusively as a projectile by spectators.

Other deficiencies in known designs include excessive complexity of design, a large number of moving parts giving rise to complexity in installation, production and maintenance expense, exposed edges or protrusions on which clothing can catch, exposed back regions enabling inadvertent foot contact from behind, poor reliability, poor ergonomics, and premature degradation due to environmental exposure.

It is an object of the present invention to overcome or ameliorate one or more of these disadvantages of prior art, or at least to provide a useful alternative.

BRIEF SUMMARY OF THE INVENTION

Accordingly, the invention provides a A tip-up seat assembly including:

a backrest, adapted to be secured to a supporting structure in a generally upright orientation;

a corresponding seat member adjacent the backrest, hingedly mounted for rotation between an open position wherein the seat member is substantially horizontal and a folded position wherein the seat member is tilted upwardly toward the backrest;

bias means for biasing the seat member toward the folded position; and a tilt-limiter configured to resiliently restrain the seat member in an intermediate position thereby avoiding inadvertent rotation of the seat member into the folded position.

Preferably, the tilt-limiter includes a resilient arm having a free end for engagement with a contact surface to provide a counter-force against the bias means. The contact surface may be located on the seat member or the backrest.

Preferably, as the seat member rotates from the open position toward the intermediate position under the effect of the biasing means, the free end of the resilient arm engages the contact surface. Further rotation of the seat member preferably causes increasing deformation of the finger, thereby providing an increasing counter-force on the contact surface acting against the direction of rotation. Eventually the counter-force and bias force will be in equilibrium and a steady state will preferably be reached. This preferably corresponds to the intermediate position.

Preferably the tilt-limiter is located on the backrest and the contact surface is located on the seat member.

Preferably, the backrest includes a pair of generally parallel, spaced apart, horizontally oriented arms extending from a lower portion of the backrest and the seat member preferably includes a top surface having a pair of complementary recesses extending from a rear edge of the seat member adjacent to the backrest to receive and locate the corresponding horizontal arms of the backrest.

Preferably, each arm includes an upper channel portion for receiving a corresponding pair of cantilever support rails of the supporting structure.

Preferably, the seat member includes a pair of apertures each positioned for axial alignment with a corresponding respective apertures at the distal end of each rail, to permit hinged connection between the seat member and the supports by respective hinge pins extending through the pairs of aligned apertures.

Preferably, each arm includes a lower housing beneath each channel for receiving the tilt limiter, and the housing preferably incorporates a forwardly projecting opening.

Preferably, a pair of generally parallel, closely spaced sidewalls extends downwardly from the respective longitudinal edges of each recess.

Preferably, the depth of the sidewalls are stepped so that the rearward sections extend further from the recess and join at a lower abutment wall to form a pocket. Preferably, the pocket is open at the rear and enclosed at the front by a contact wall having a top ledge, and inner and outer contact surfaces.

Preferably, the apertures on the seat member are located near the forward ends of each corresponding pair of sidewalls.

Preferably, the bias means is counter-weight located on the seat member, adjacent a rear peripheral edge.

Preferably, the counter weight is snap lockingly engaged to the seat member.

Preferably, the tilt limiter is formed as a unitary component from a resilient plastics material.

Preferably, the tilt-limiter includes specially shaped upper and lower arms joined at a common end to define a nose formation.

Preferably, the nose formation is generally in the shape of a V-clip.

Preferably, the upper arm extends forwardly of the nose to define a retaining latch and complementary upper locating stop for engagement with a complementary lug within the housing. Similarly, a lower locating stop is preferably disposed on the lower arm for engagement with a corresponding lower lug in the housing thereby securing the tilt-limiter within the housing.

Preferably, the upper arm also includes the resilient finger having secondary and primary bows respectively disposed concave upwardly and downwardly facing.

Preferably, the lower arm also includes an auxiliary bow and free end for engaging the inner contact surface of the seat member when the seat is in the open position. This preferably deforms the auxiliary bow and provides an initialising bias force for the seat member away from the open position.

Preferably, the free end is substantially F-shaped.

Preferably, the backrest includes a generally horizontally concave and vertically convex front surface for contacting and supporting the lower to mid section of the sitter's back Preferably, backrest also includes a plurality of spaced ribs formed into the outside surface facing away from the sitter, and a peripheral apron on the top and sides to increase strength and rigidity.

BRIEF DESCRIPTION OF THE DRAWINGS

A preferred embodiment of the invention will now be described, by way of example only, with reference to the accompanying drawings in which:

FIG. 6*a*(ii) is a perspective view of the tilt-limiter shown in FIG. 6*a*(i);

FIG. 6*b*(ii) is a perspective view of the tilt-limiter shown in FIG. 6*b*(i);

FIG. 6*c*(i) is a side view of another form of the tilt-limiter shown in FIG. 6*a*(i);

FIG. 6*c*(ii) is a perspective view of the tilt-limiter shown in FIG. 6*c*(i);

DETAILED DESCRIPTION OF THE INVENTION

Figure 1A:
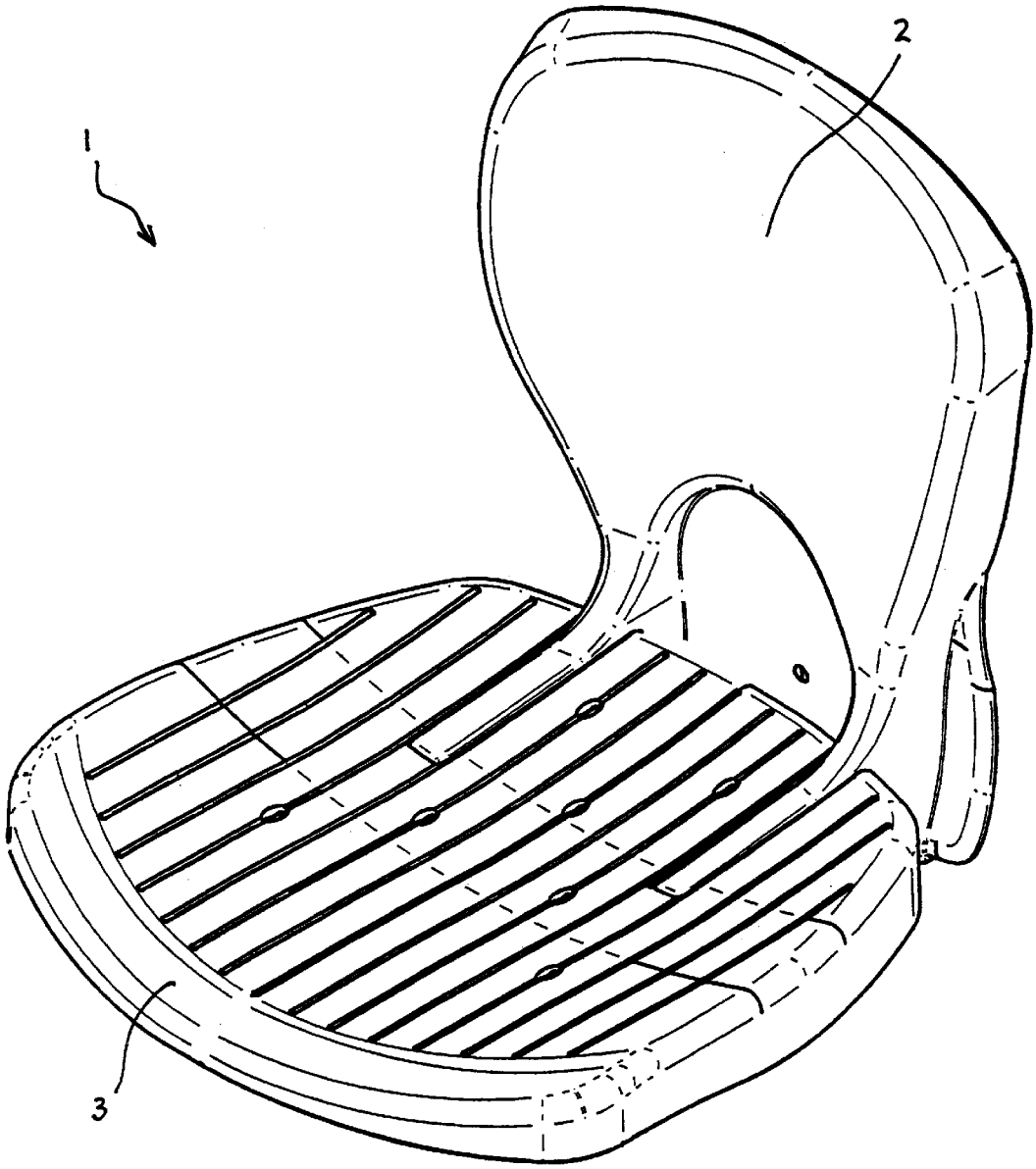
FIG. 1*a* is a front perspective view showing the upper surfaces of a tip-up seat assembly according to the invention.
Figure 1B:
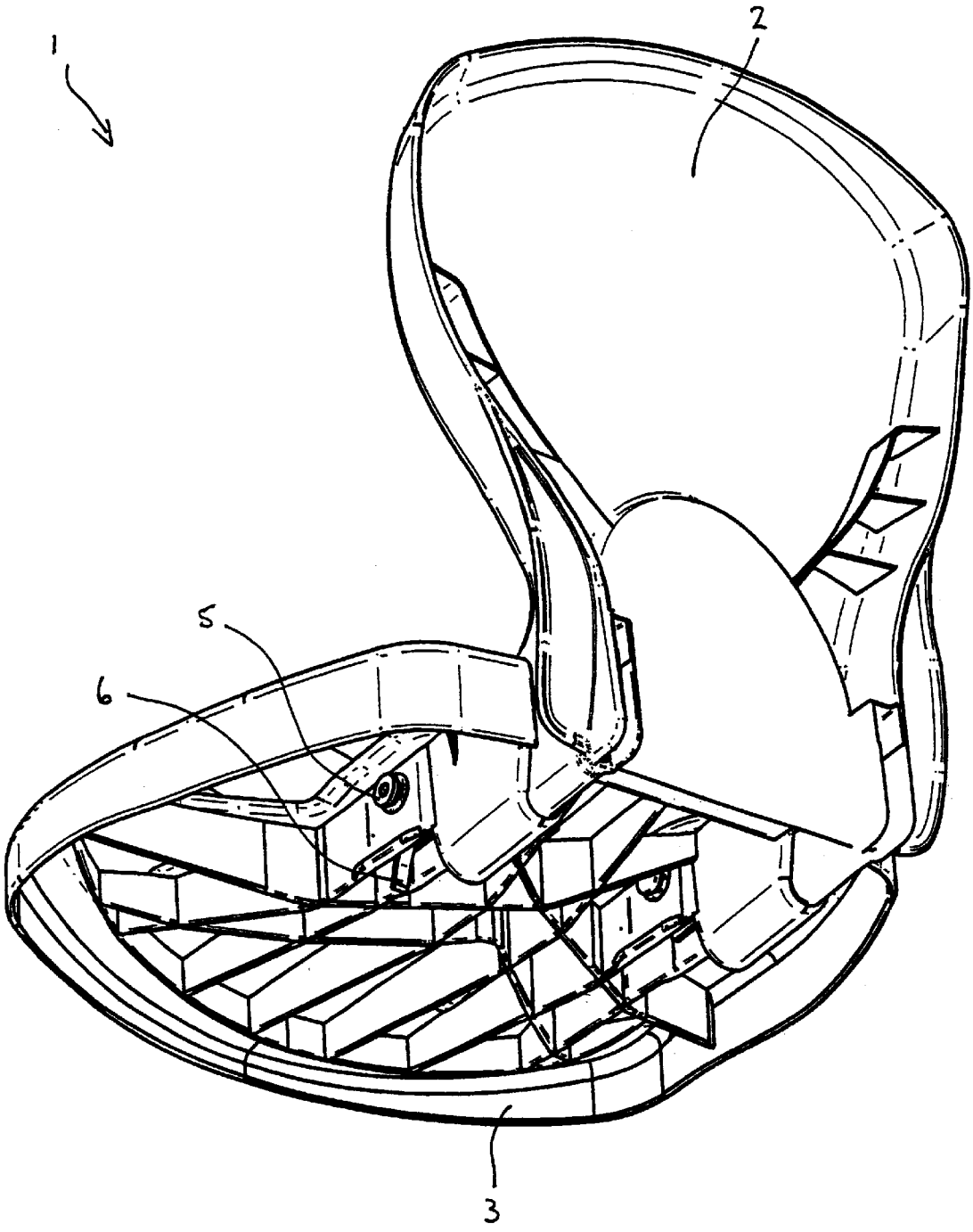
FIG. 1*b* is a rear perspective view showing the underside of the tip-up seat assembly of FIG. 1*a;*
Figure 1C:
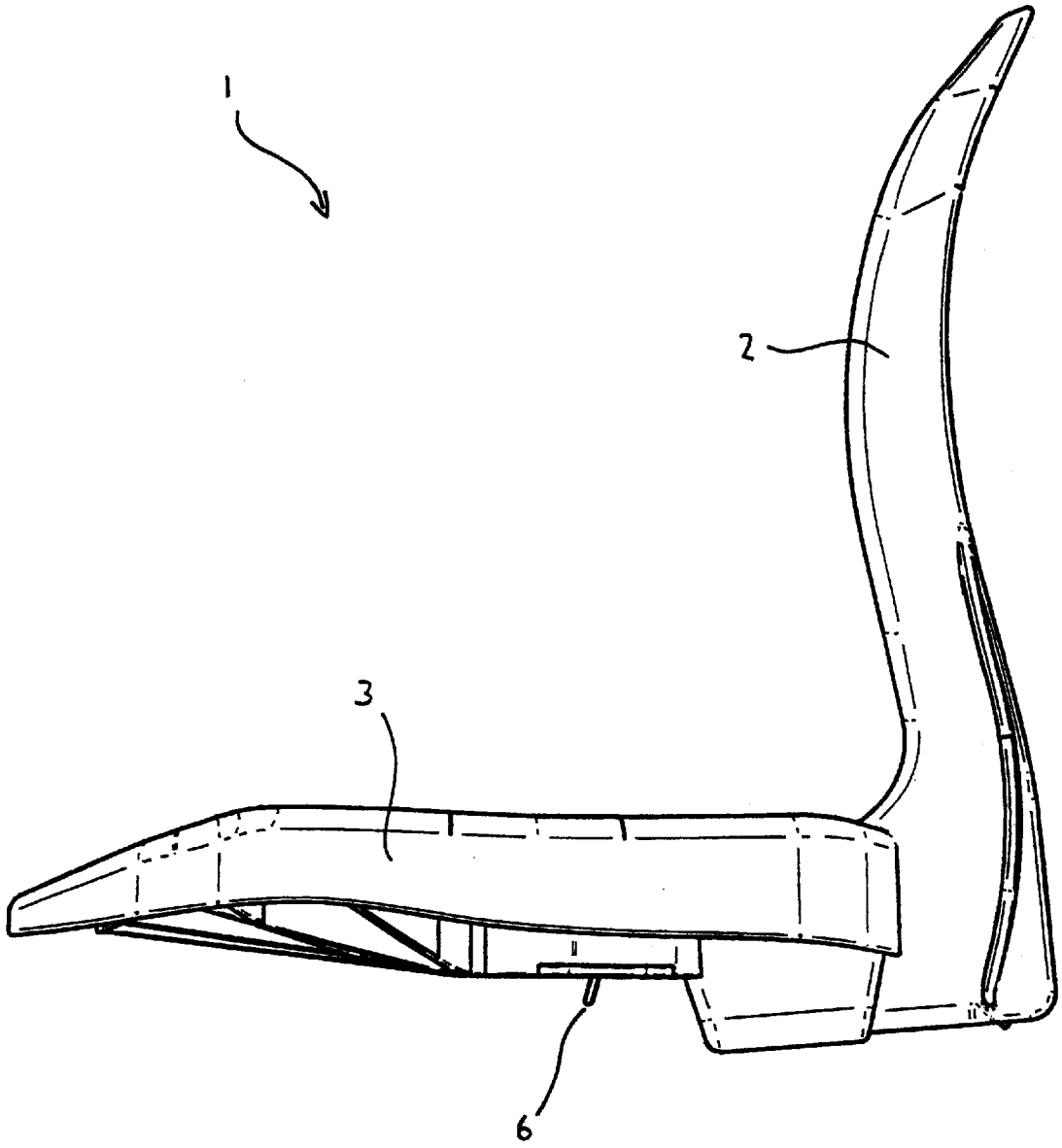
FIG. 1*c* is a right-side view of the tip-up seat assembly of FIG. 1*a;*
Figure 1D:
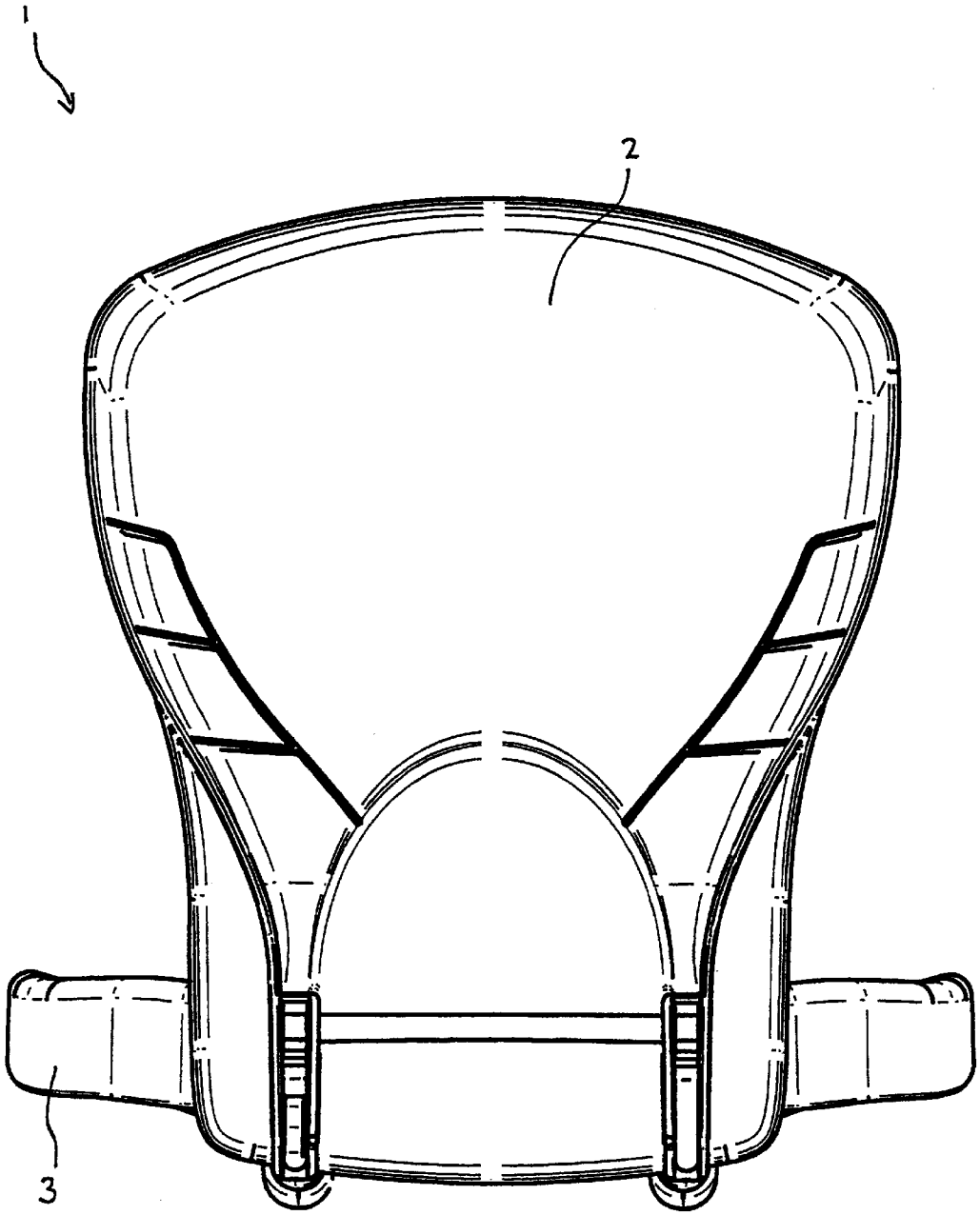
FIG. 1*d* is a rear view of the tip-up seat assembly shown in FIG. 1*a;*
Figure 1E:
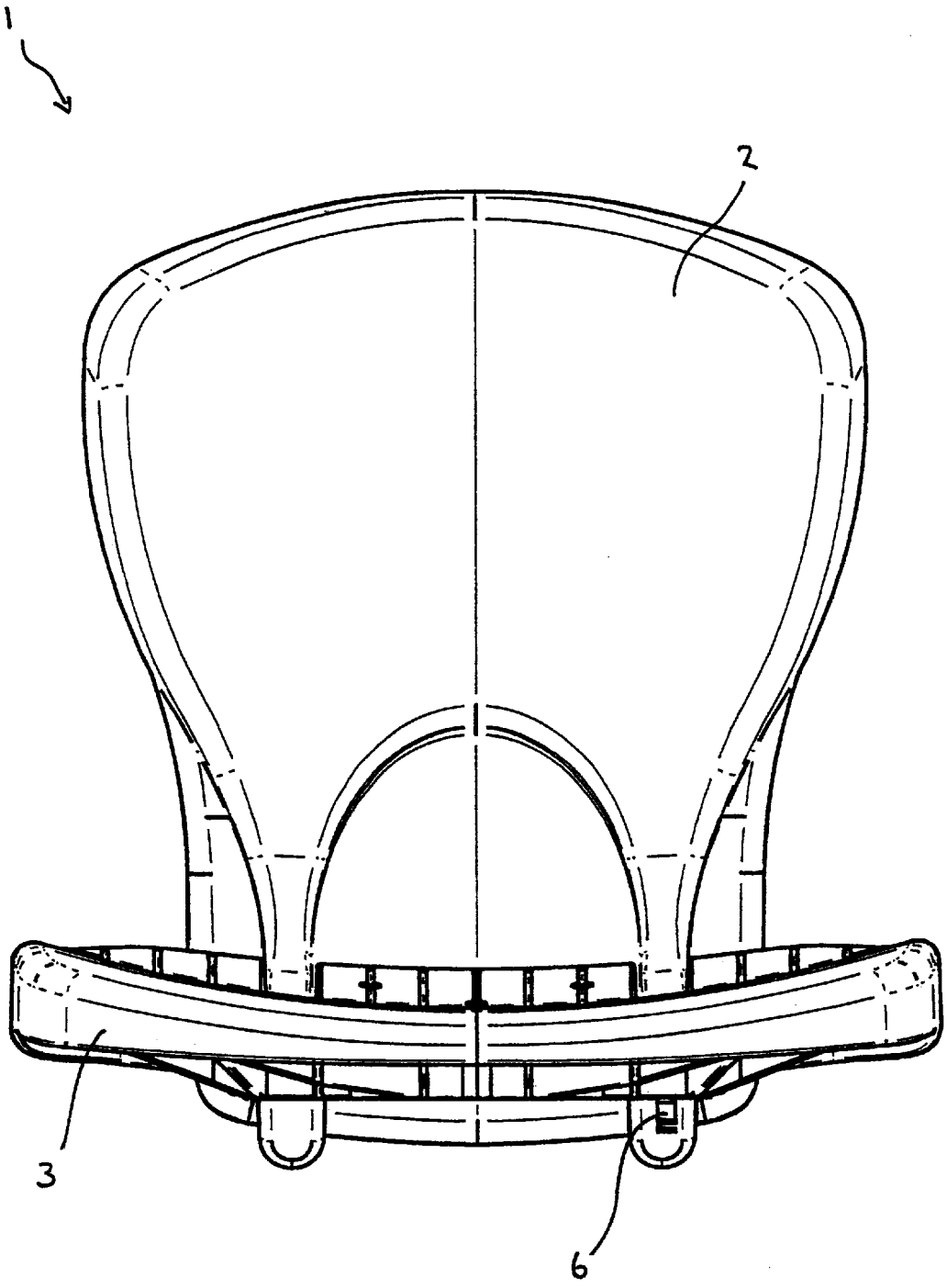
FIG. 1*e* is a front view of the tip-up seat assembly shown in FIG. 1*a;*
Figure 1F:
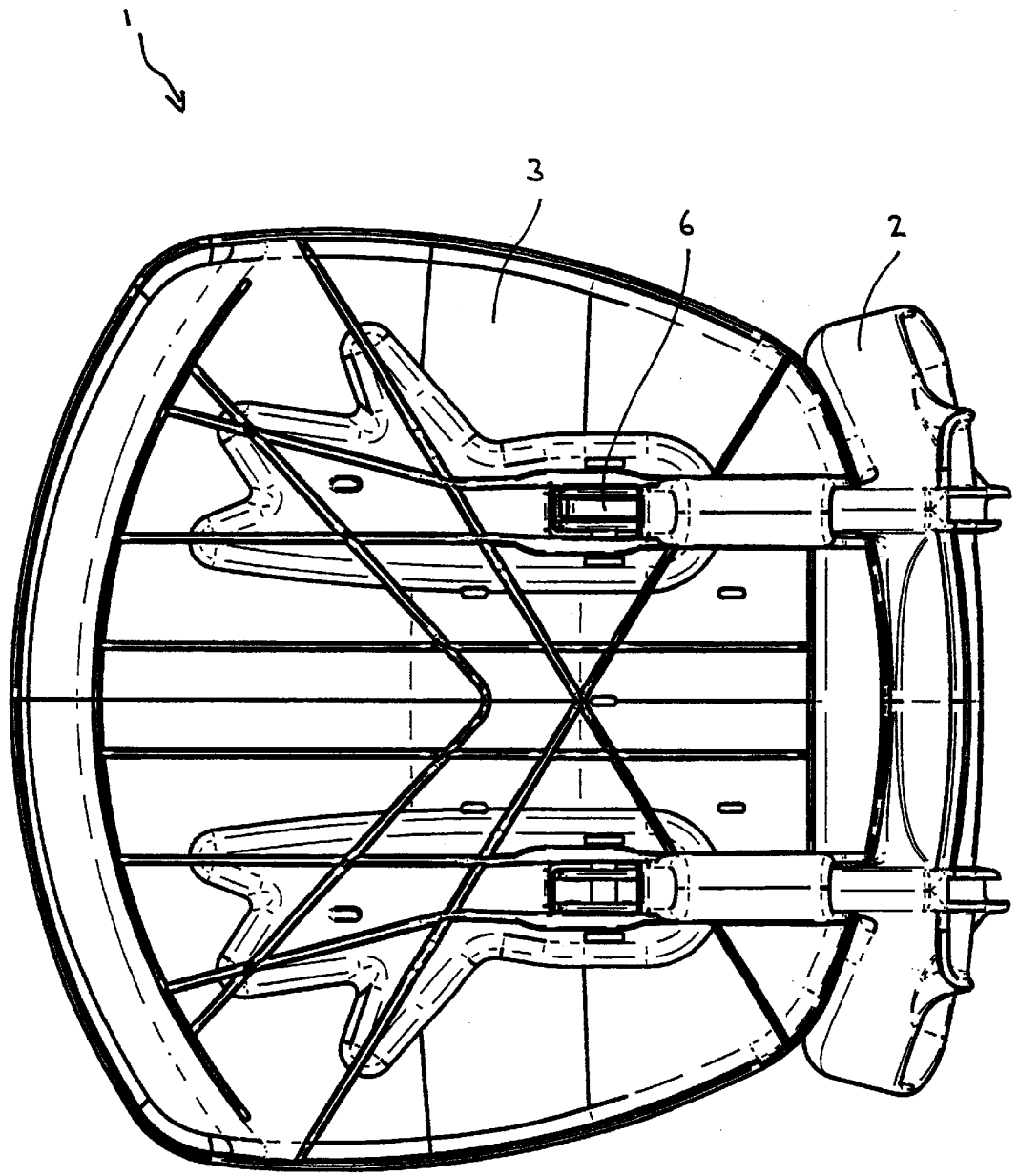
FIG. 1*f* is a bottom view of the tip-up seat assembly shown in FIG. 1*a;*
Figure 1G:
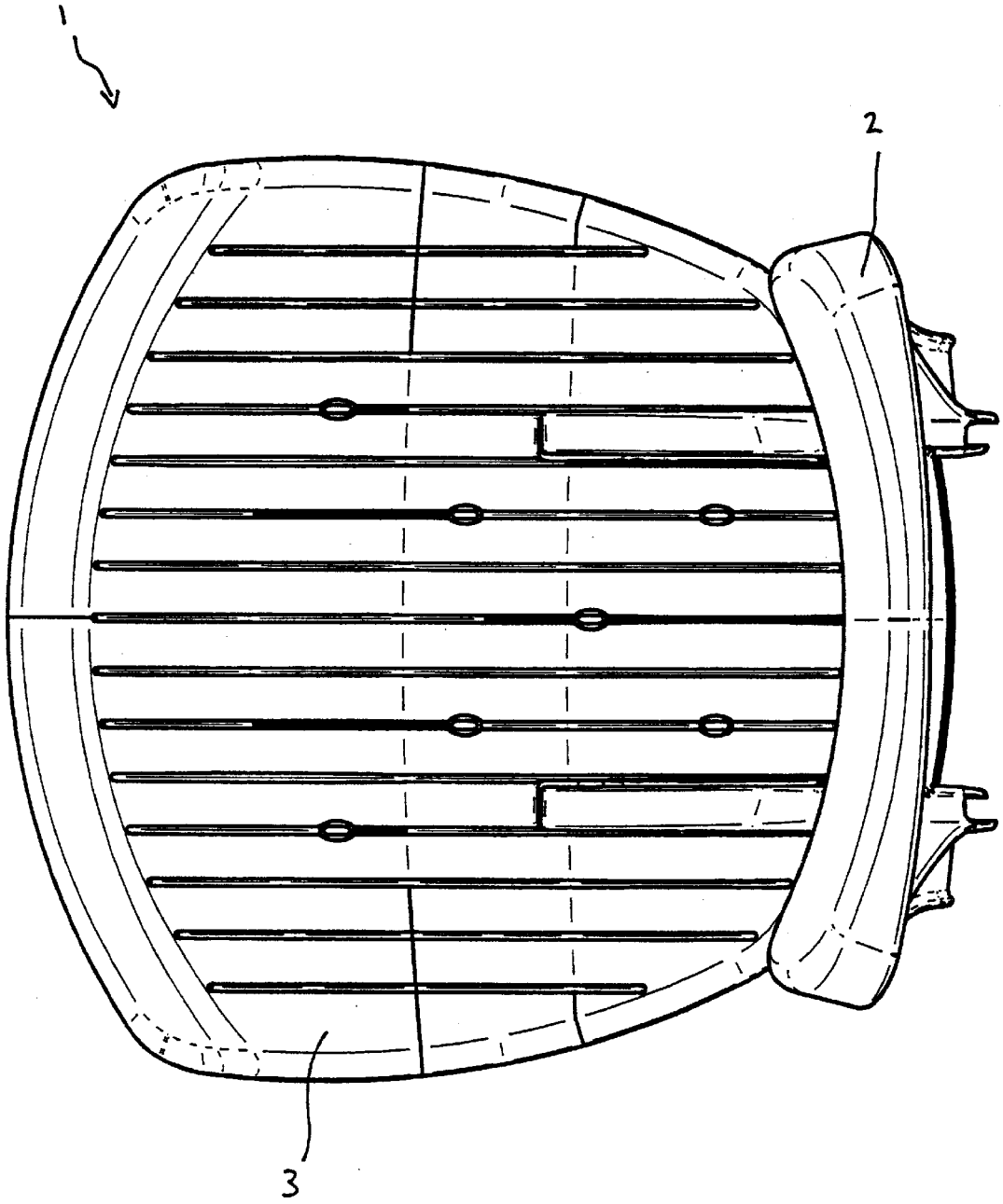
FIG. 1*g* is a top view of the tip-up seat assembly shown in FIG. 1*a;*

Referring to the drawings, the invention provides a tip-up seat assembly 1 including a backrest 2 and seat member 3. The backrest 2 is adapted to be mounted to a support structure 4 in a generally upright orientation.

Figure 13A:
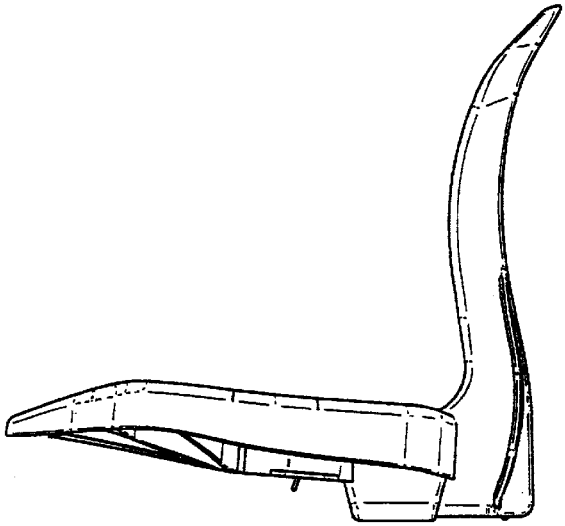
FIG. 13*a* is a side view of the tip-up seat assembly of FIG. 1*a* with the seat member in the open position.
Figure 13B:
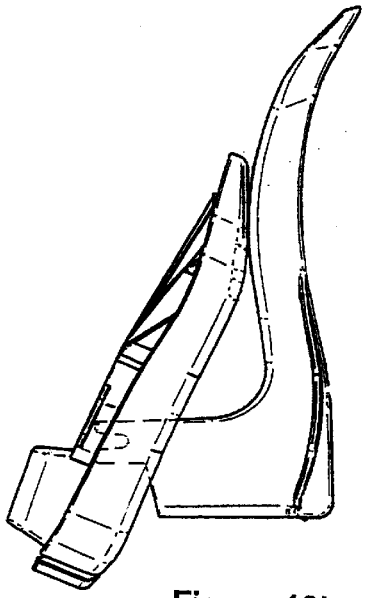
FIG. 13*b* is a side view of the tip-up seat assembly of FIG. 1*a* with the seat member in the fold position.
Figure 13C:
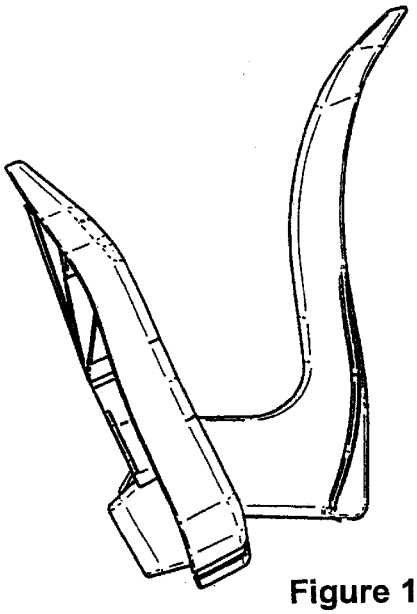
FIG. 13*c* is a side view of the tip-up seat assembly of FIG. 1*a* with the seat in an intermediate position.
Figure 13D:
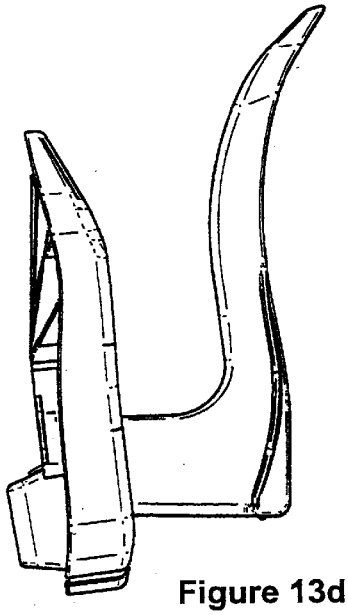
FIG. 13*d* is a side view of the tip-up seat assembly of FIG. 1*a* with the seat member in a second intermediate position.

The seat member 3 is rotatable around a pair of horizontally oriented axially aligned pivot pins 5, between a open position wherein the seat member is substantially horizontal, as shown in FIG. 13*a*, and folded or retracted position wherein the seat member 3 is tilted upwardly toward the backrest 2, as shown in FIG. 13*b*. While the seat member 3 is biased toward the folded position, a tilt-limiter 6 is configured to resiliently restrain the seat member 3 in an intermediate position, as seen in FIGS. 13*c* and 13*d*, thereby avoiding inadvertent rotation of the seat member into the folded position. In this way, the rest position of the seat member is an intermediate position between the open position and the folded position. However, the seat member 3 may be manually held, against the resilient bias force of the tilt-limiter 6, in the fully folded or retracted position so as temporarily to allow a greater degree of access around or under the seat 1.

Figure 2A:
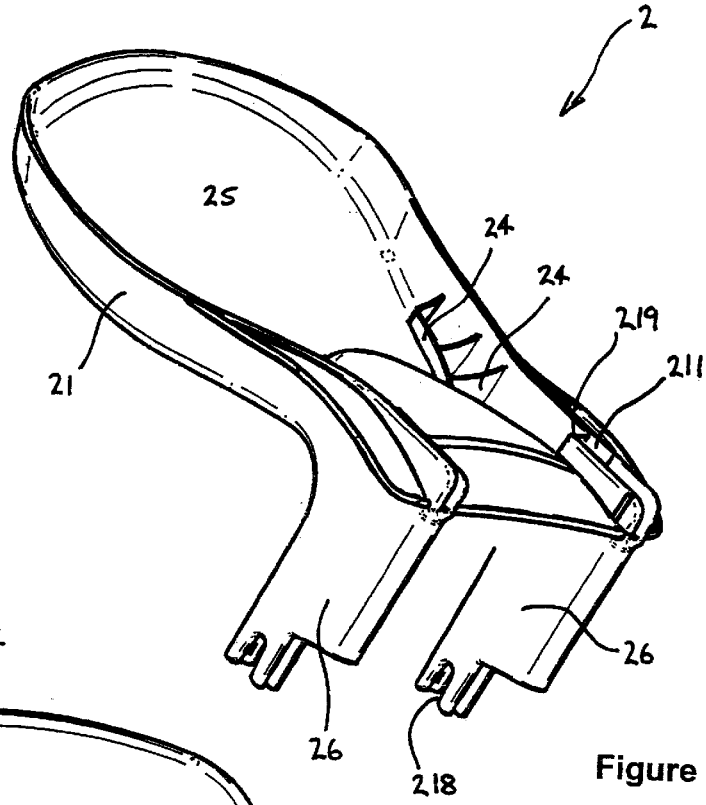
FIGS. 2*a* and 2*b* are perspective views of a back-rest according the invention.
Figure 2B:
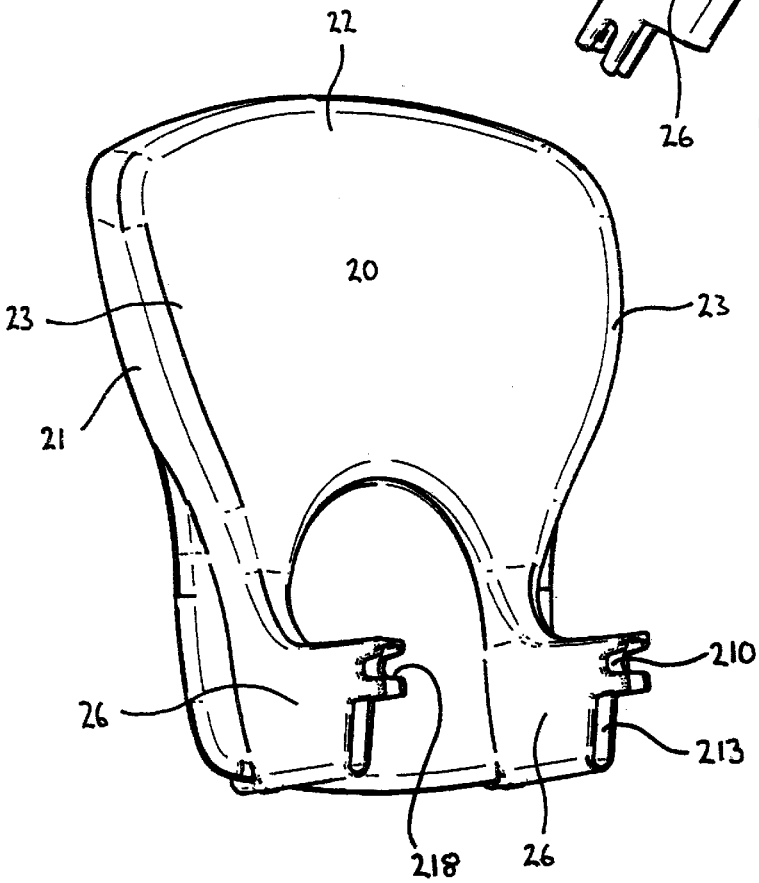

Turning to consider the construction of the seat assembly in more detail, as shown in FIGS. 2*a* and 2*b*, the backrest 2 includes a front surface 20 for contacting and supporting the lower to mid section of the sitter's back. The front surface 20 is shaped to be generally horizontally concave and vertically convex and is thereby ergonomically sculptured for comfort and lumbar support. This shape also defines the seat boundary, making it uncomfortable for an individual to spread over more than one seat at a time.

The backrest itself is relatively rigid and effectively continuous, so as to shield the back of the occupant. In particular, this prevents inadvertent contact by the feet of the sitter positioned in the next row behind. A peripheral apron 21 surrounds the backrest on the top 22 and sides 23 to provide a measure of additional strength and rigidity. The backrest 2 also includes ribs 24 formed into the outside surface 25 facing away from the sitter, to further enhance strength and rigidity. These ribs 24 are configured and spaced relative to one another, to provide the degree of stiffness required for the particular material composition of the seat and the intended application.

Figure 9:
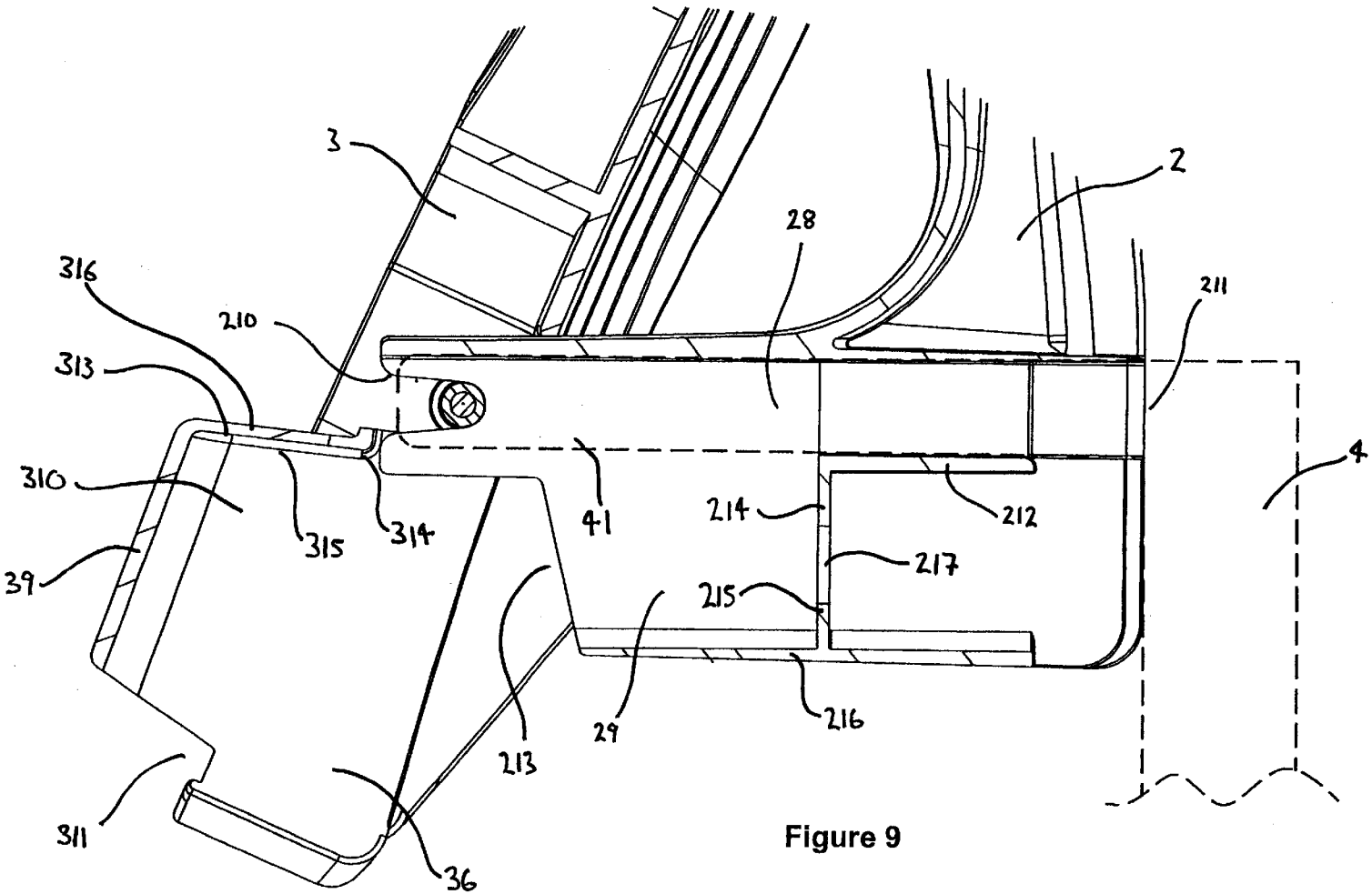
FIG. 9 is a detailed cross-sectional view of FIG. 8.

A pair of generally parallel, spaced apart, horizontally oriented arms 26 extends forwardly from either side of a lower portion of the backrest 2. As seen in FIG. 9, a cross section through the centre of one of arms, each arm 26 includes an upper channel portion 28 and a lower housing 29. The channel 28 extends over the horizontal length of the arm 26 and is accessed via forward and rear openings 210, 211, at the distal and proximal ends of the arms 26, respectively. The channel 28 is defined at its lower proximal half by a boundary wall 212.

Figure 3A:
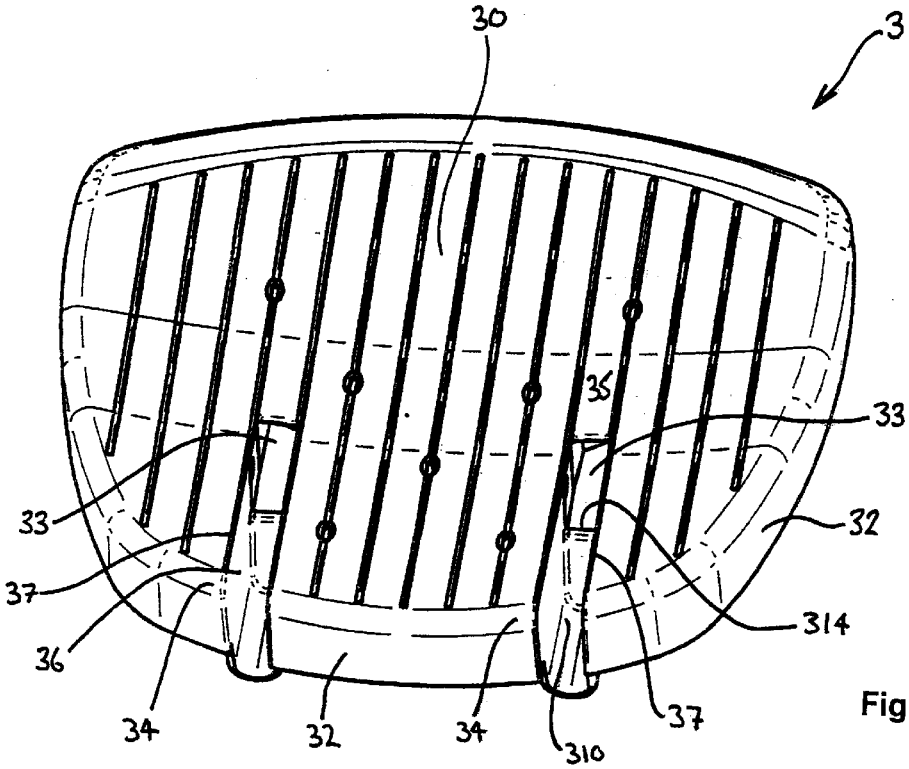
FIGS. 3*a* and 3*b* are perspective views of a seat member according the invention.
Figure 3B:
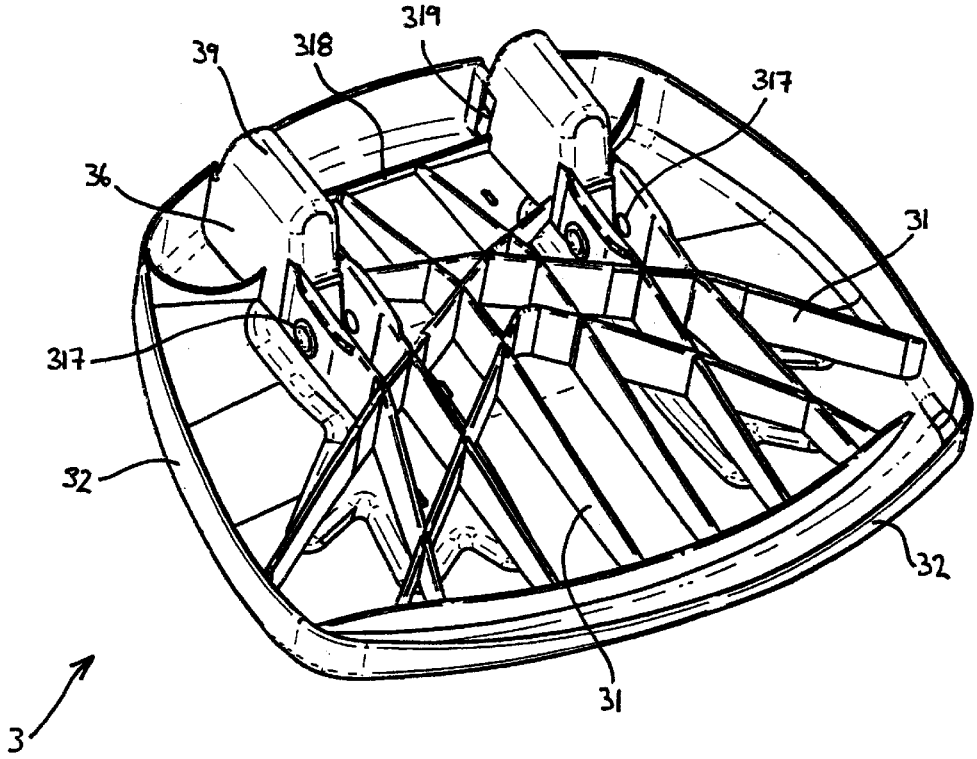

As displayed in FIGS. 3*a* and 3*b*, the housing 29 is disposed underneath the channel 28, at the distal end of each arm, and is accessed by a forward opening 213 common with the forward opening 210 of the channel. Two internal, oppositely orientated locating lugs, 214, 215 extend respectively from the channel boundary wall 212 at the top, and a lower wall 216 at the bottom of the housing to define an intermediate gap 217.

The seat member 3 includes an ergonomically concaved top surface 30 for comfort, and a plurality of underside ribs 31 for increased rigidity and strength. Like the backrest, the seat member also includes a peripheral apron 32 for enhanced stiffness. The top surface 30 has a parallel pair of spaced apart elongate recesses 33 adapted respectively to receive and locate the corresponding horizontal arms 26 of the backrest 2. Each recess 33 runs forwardly from the rear edge 34 adjacent to the backrest 2 toward a central region 35 of the seat. A pair of generally parallel, closely spaced sidewalls 36 extends downwardly from the respective longitudinal edges 37 of each recess 33. Referring to the cross sectional view through the recess shown in FIG. 9, the depth of these sidewalls 36 is stepped such that the rearward sections run deeper and join at a lower abutment wall 39 to form a pocket 310. This pocket is open at the rear 311 and enclosed at the front by a contact wall 313 having a top ledge 314, and inner and outer contact surfaces 315, 316. A pair of axially aligned apertures 317 is located near the forward ends of each corresponding pair of sidewalls to receive the pivot pin 5, which thereby extends through the associated channel.

As seen in FIG. 3*b*, a locating formation 318 at the rear underside peripheral edge of the seat member is adapted to receive and locate the counter-weight 7 which includes a weight 71 contained within a detachable cover or housing 72 and when installed, biases the seat member toward the folded position. The cover includes snap locking formations 73 for releasable engagement with corresponding formations 319 on the seat member 3.

Tilt limiter 6 disposed on one side of the seat regulates the movement of the seat member 3 relative to the backrest 2 and the supporting frame. As seen in FIG. 6, the tilt limiter 6 is formed as a unitary component from a resilient plastics material including specially shaped upper and lower arms 61, 62 joined at a common end to define a V-clip formation 63. The upper arm 61 extends forwardly of the V-clip to define a retaining latch 64, and complementary upper locating stop 65, a resilient finger 68, secondary and primary bows 66, 67 respectively disposed concave upwardly and downwardly facing, and finger tip 69 at the free end. The lower arm 62 extends forwardly of the V-clip 63 immediately beneath the upper arm, to define a lower locating stop 610, an auxiliary bow 611 and an F-shaped head 612 at the free end of the lower arm, the F-shaped head including an abutment nub 613, a positioning overhang 614 and a beveled contact formation 615. The function and operation of these elements will become more apparent from the description below.

In another embodiment, the auxiliary bow 611 of the lower arm 62 of the tilt limiter 6 extends to join the upper arm 61 at the secondary bow 66. The F-shaped head 612 is replaced by a flipper 616 which extends downwardly and forwardly from the secondary bow 66.

Figure 4:
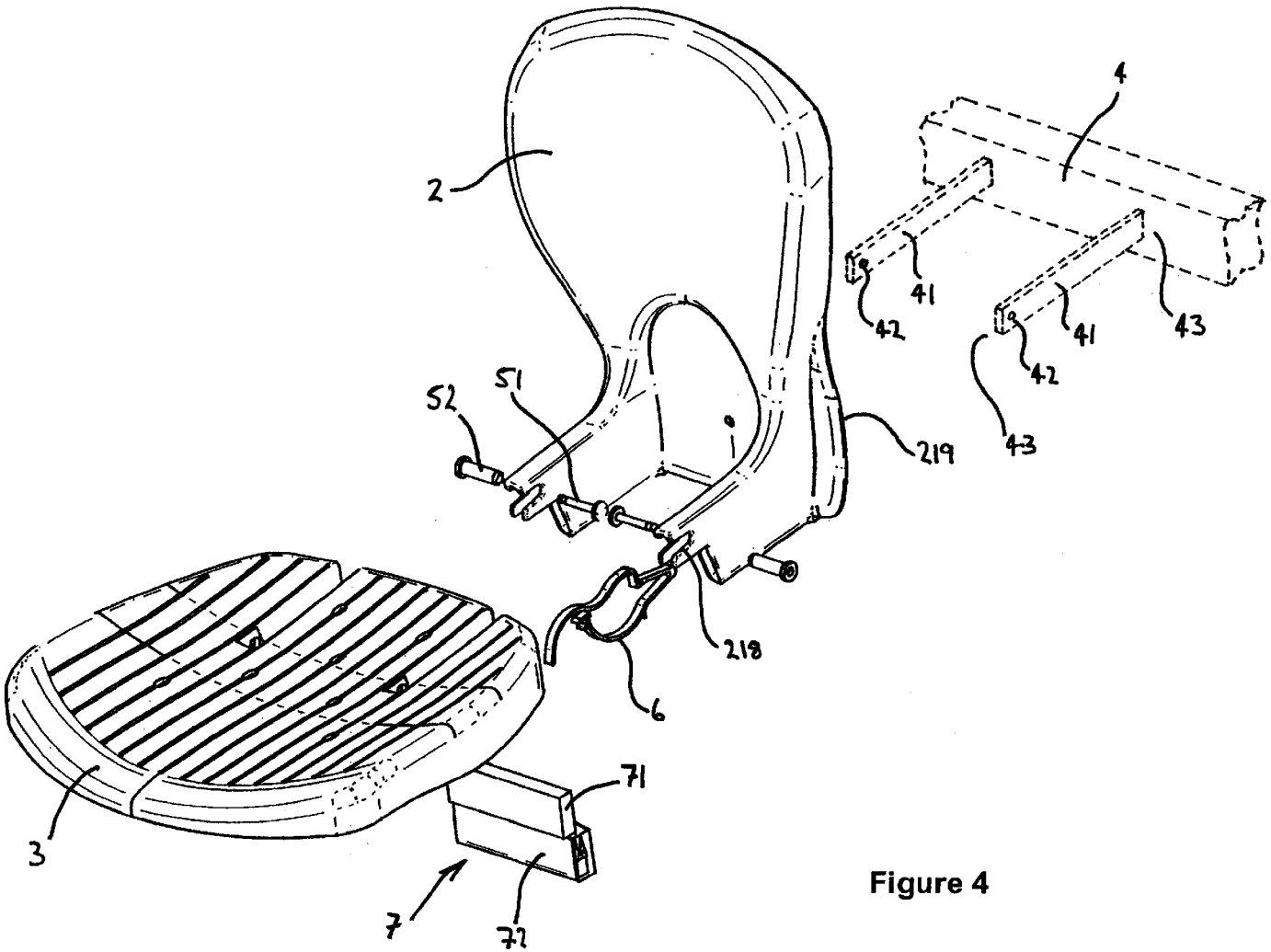
FIG. 4 is an exploded perspective view of the tip-up seat assembly shown in FIG. 1*a;*
Figure 5A:
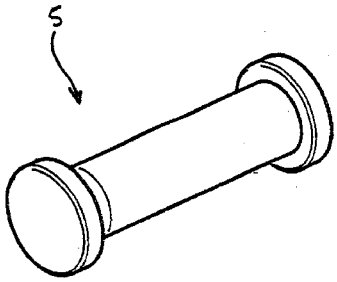
FIG. 5*a* is a perspective view of a hinge pin according the invention.
Figure 5B:
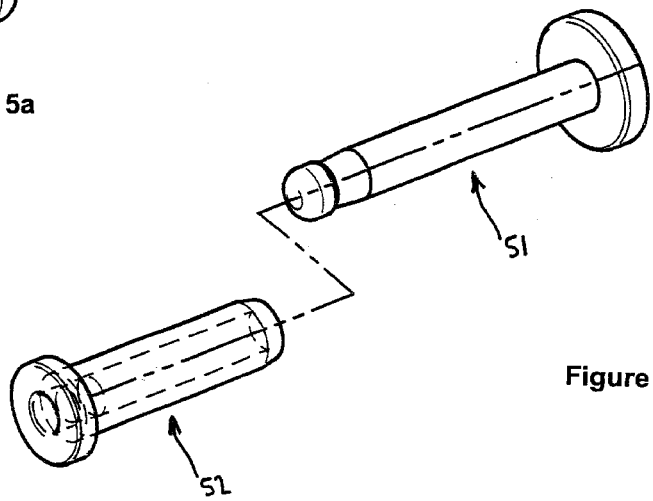
FIG. 5*b* is an exploded perspective view of the hinge pin of FIG. 5*a;*
Figure 5C:
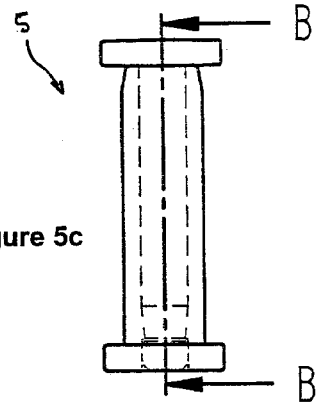
FIG. 5*c* is a side view of the hinge pin shown in FIG. 5*a;*
Figure 5D:
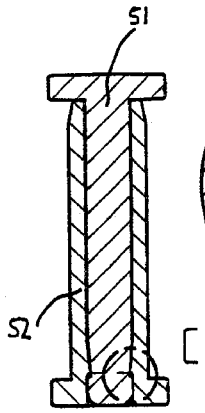
FIG. 5*d* is a cross-sectional view of FIG. 5*c;*
Figure 5E:
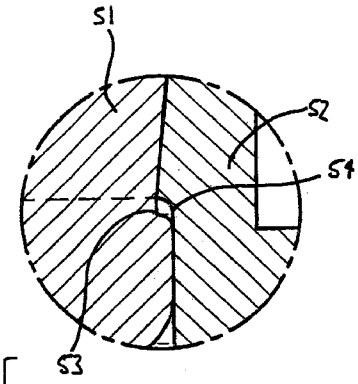
FIG. 5*e* is a detailed view of FIG. 5*d;*
Figure 6A:
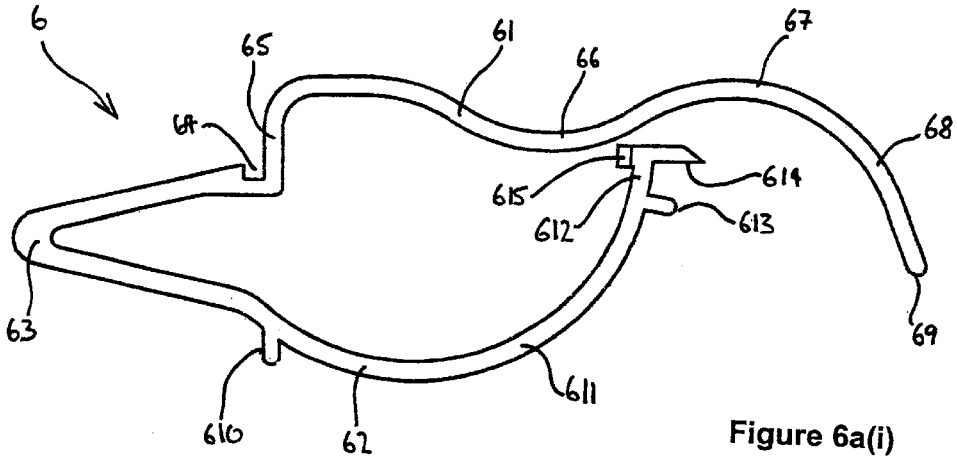
FIG. 6*a*(i) is a side view of a tilt-limiter according the invention.
Figure 6B:
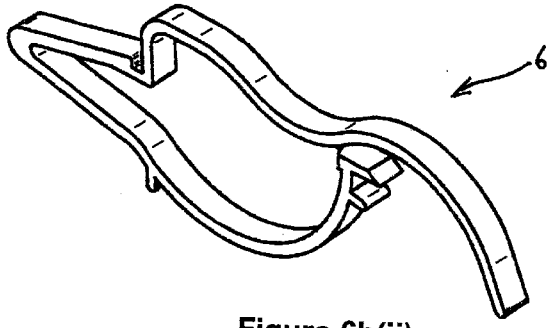
FIG. 6*b*(i) is a side view of an alternative form of the tilt-limiter shown in FIG. 6*a*(i)
Figure 6B:
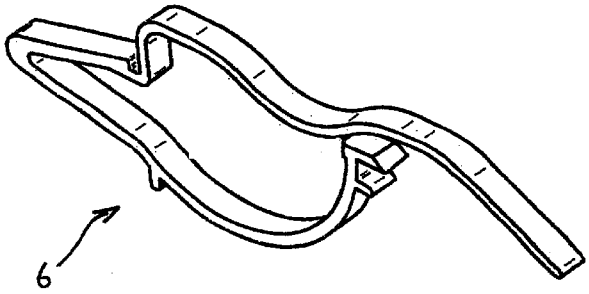
Figure 6B:
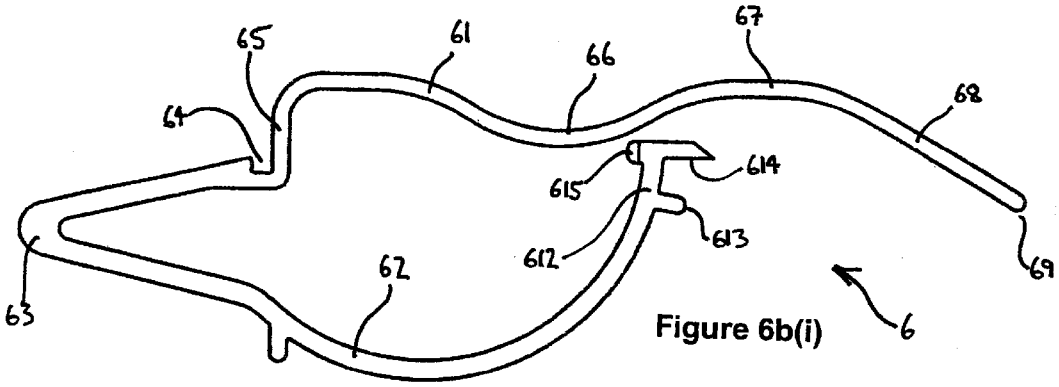
Figure 7A:
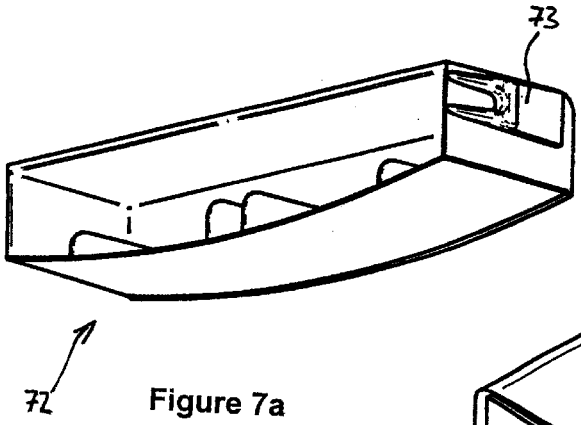
FIGS. 7*a* and 7*b* are perspective views of a counter-weight cover according to the invention.
Figure 7B:
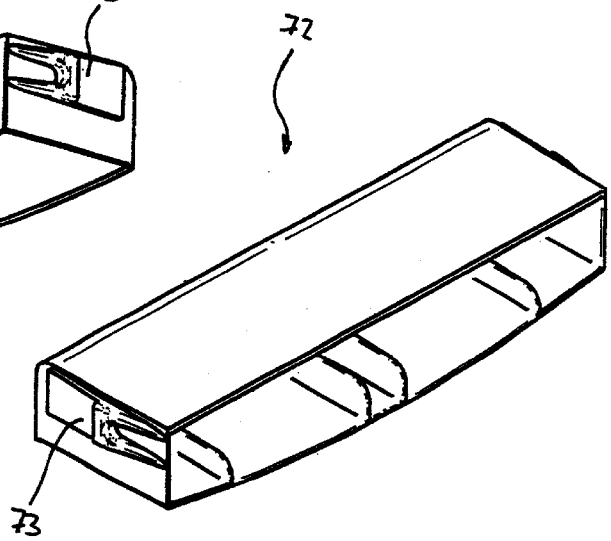
Figure 8:
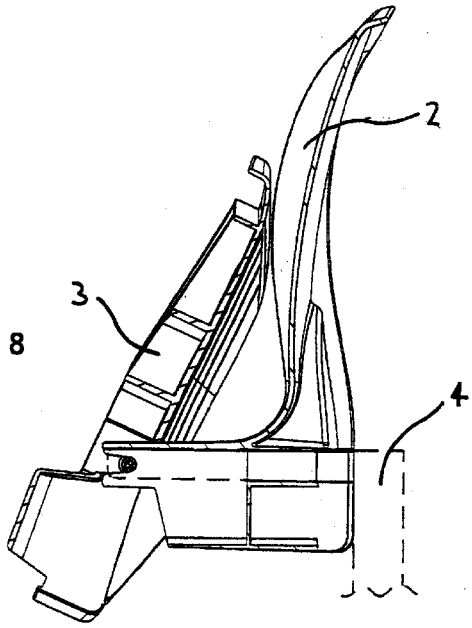
FIG. 8 is a cross-section of the seat assembly shown in FIG. 1(*a*) with the seat member in the folded position, through one of the arms.

Turning now to describe the assembly and interaction of the constituent components of the seat, the backrest 2 is initially secured to the supporting structure 4, usually in the form of a steel frame, which may be bolted or otherwise anchored to a concrete footing. As shown in FIG. 4, the frame incorporates a pair of generally parallel, spaced apart, horizontally disposed cantilevered support rails 41 which in use are positioned to extend forwardly through the respective channels in the backrest 2. The support rails 41 include a corresponding pair of horizontally aligned apertures 42 at their respective distal ends 43. Each support rail 41 extends through the corresponding channel 28 on the backrest such that the aperture 42 can be accessed by means of a recess 218 in a sidewall of the associated channel 28. The backrest is prevented from moving further back on the rails 41 than desired by engagement of a stop on the seat 219 with a complementary abutment surface 43 on the support frame. In this position, the backrest is securely mounted to the supporting structure and any load on the backrest is distributed relatively uniformly along the length of the interface between the channels 28 and the supporting frame rails 41. This helps to avoid localised stress concentrations and consequential component failure.

Figure 10A:
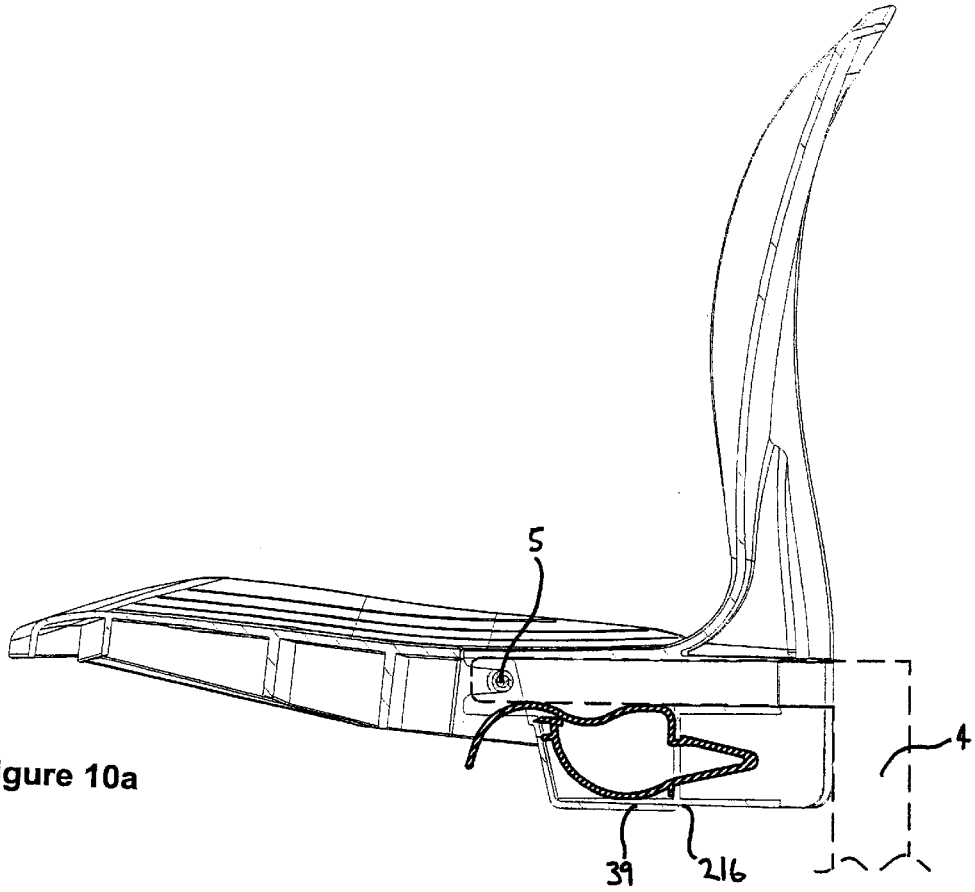
FIG. 10*a* is a cross-sectional view of the tip-up seat assembly of FIG. 1*a* with the seat member in the open position and the tilt-limiter shown in FIG. 6*a* installed.
Figure 10B:
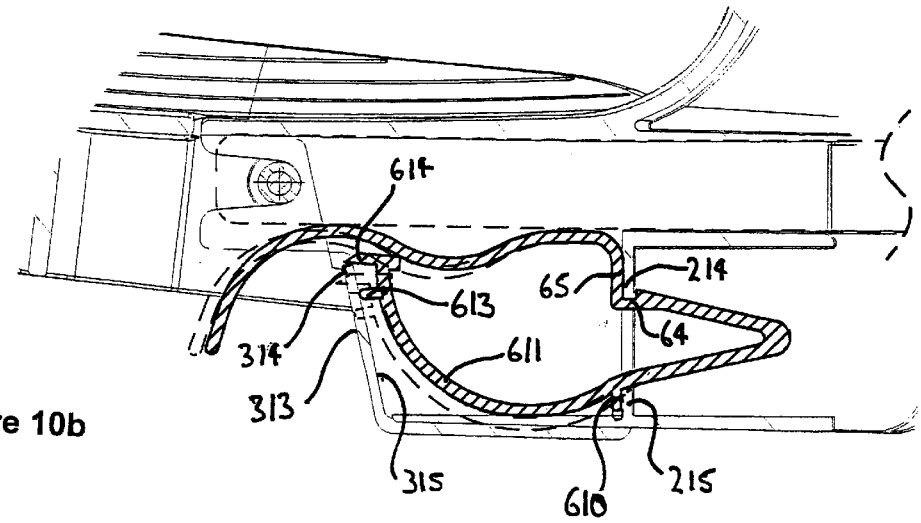
FIG. 10*b* is a detailed cross-sectional view of FIG. 10*a* showing the undeformed tilt-limiter in ghost.

Tilt-limiter 6 is then inserted into one of the housings 29 on the backrest 2 so that the resilient V-clip 63 passes through gap 217, between the locating lugs 214, 215, to the use position where it clicks securely into place. At this point, the upper and lower locating stops 65, 610 abut the respective locating lugs 214, 215 while the latch 64 engages the top lug 214, thus preventing inadvertent extraction of the tilt-limiter 6. In this position, the upper and lower arms 61, 62 of tilt limiter 6 extend forwardly of the associated V-clip 63 in a generally horizontal orientation, with the finger 68 and F-shaped head 612 extending from the front opening 213 of the housing 29. The installed tilt limiter 6 is shown in FIG. 10*b*.

In the case of the alternative tilt limiter shown in FIG. 6*c*, the tilt limiter is inserted into the housing in a similar manner however, it is the flipper 616 rather than the F-shaped head extends from the front opening 213 of the housing 29.

The seat member 3 is then positioned such that the apertures 317 in the recessed sidewalls 36 are aligned with the apertures in the rails 42. The two-piece pivot pins 5 are then inserted through the respective apertures on each side of the seat. Each pivot pin 5 includes a central shaft 51 and an outer sheath 52. Corresponding formations 53, 54 are located on the shaft and the sheath, which engage to provide what is in effect a one-way snap-locking rivet. Each pin thereby provides a hinge, and the pins are coaxially aligned to define a common hinge axis about which the seat member can rotate. The pivot pins are ideally formed from a relatively rigid, high-strength plastics material and the complementary snap-locking engagement formations are preferably designed to prevent disassembly without special tools, so as to resist inadvertent or unauthorised disassembly. Care must be taken to ensure that finger 68 of the tilt-limiter extends between the pivot pin 5 and the associated outer contact surface 316. In this position, and with the seat member installed, the tilt limiter 6 cannot be easily withdrawn from its housing 29, thereby preventing the seat, and in particular the tilt-limiter, from being vandalised, disassembled or removed.

The counter-weight 7 is then installed. The weight 71 and its cover 72 are guided into position by the corresponding locating formations 318 on the seat member and is progressively inserted until the snap-locking formations 73 on the cover 72 engage the corresponding formations 319 on the seat member. The catches on the counter-weight cover are sufficiently deep to reduce the possibility of the counter-weight and cover being removed from the seat member without the use of special tools, again to resist inadvertent or unauthorised disassembly.

When the seat is occupied, or sufficient weight is otherwise applied forwardly of the hinge axis, the seat member 3 rotates downwardly and forwardly into the use position. In this position, shown in FIG. 10*a*, the seat member acts as a cantilever with a fulcrum around the pivot pins 5, and the abutment surface 39, which forms the bottom of the pocket in the seat member, engaging a corresponding abutment surface on the lower wall 216 of the backrest housing 29, thereby providing a stable and sturdy seat and backrest combination. The top surface of each arm is configured to fill the recesses on the seat member thereby providing an effectively continuous surface to the seat. Referring to FIG. 10*b*, the F-shaped head 612 of the tilt-limiter 6 engages the vertical contact wall 314, such that the top ledge 314 is located under the positioning overhang 614 on the F-shaped head, and the inner contact surface 315 engages the abutment nub 613. In this way, the auxiliary bow 611 of the tilt-limiter is resiliently deformed and in pretension. In the case of the tilt limiter shown in FIG. 6*c*, the flipper 616 rather than the F-shaped head engages the inner contact surface 315 adjacent the pocket 310. Thus the flipper 616 is resiliently deformed and in pretension. In this embodiment, the arms form a closed loop which has been found to provide more stable, consistent and silent operation.

When the seat is unloaded, this pretension in the tilt-limiter auxiliary bow 611 acts on the inner contact surface 315 to provide an accelerating rotational force to initialise rotation of seat member 3. In the case of the tilt limiter shown in FIG. 6*c*, the flipper 616 acts on the contact surface 315 to provide the initial rotational force. This starting force is desirable to overcome any friction or stiction in the hinge mechanism that may arise due to the accumulation of debris. The counter-weight 7 at the rear of the seat then further rotates the seat member upwardly and rearwardly toward the folded position.

Figure 11A:
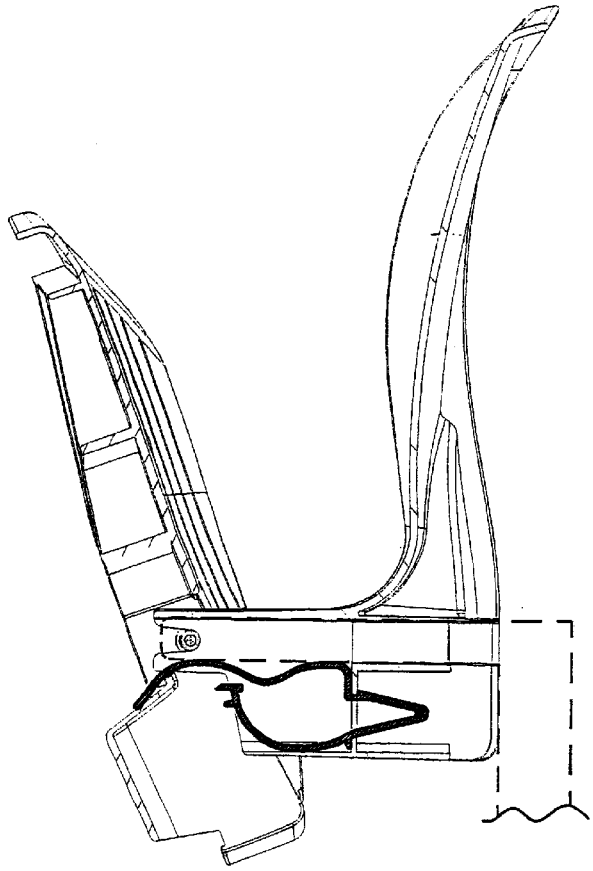
FIG. 11*a* is a cross-sectional view of the tip-up seat assembly of FIG. 1*a* with the seat member in the intermediate position and the tilt-limiter shown in FIG. 6*a* installed.
Figure 11B:
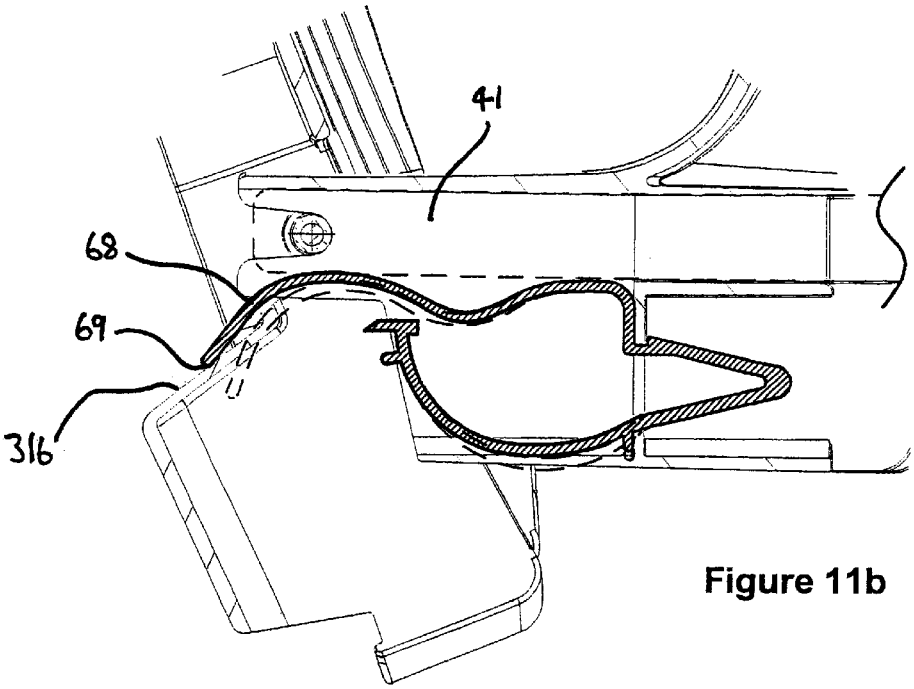
FIG. 11*b* is a detailed cross-sectional view of FIG. 11*a* showing the undeformed tilt-limiter in ghost.
Figure 12A:
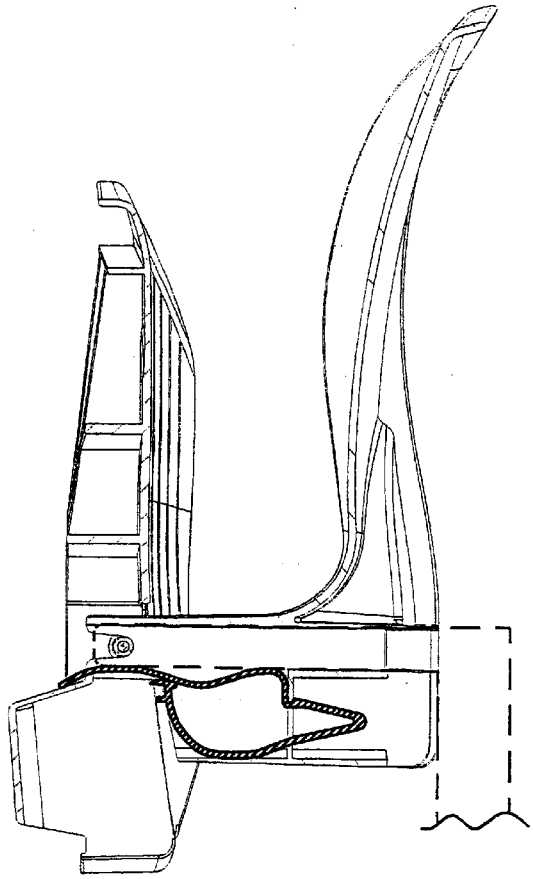
FIG. 12*a* is a cross-sectional view of the tip-up seat assembly of FIG. 1*a* with the seat member in the intermediate position and the tilt limiter shown in FIG. 6*b* installed.
Figure 12B:
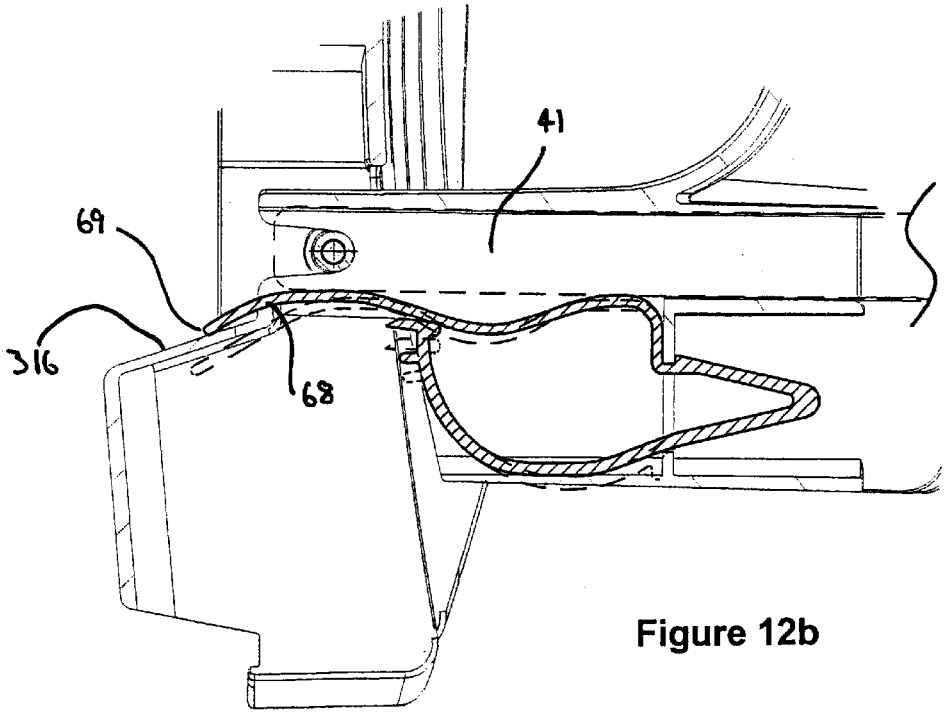
FIG. 12*b* is a detailed cross-sectional view of FIG. 12*a* showing the undeformed tilt-limiter in ghost.

As the seat member rotates from the open position toward the intermediate position, shown in FIG. 11*a*, the fingertip 69 on the resilient finger 68 of tilt limiter 6 engages the respective outer contact surfaces 316 on the seat member. Further rotation causes the finger to resiliently deform thereby providing a counter-force against the direction of rotation. Referring to FIGS. 11*b* and 12*b*, this force increases progressively as the finger 68 and primary 67 and secondary 66 bows resiliently deform. The primary bow 67 unfurls against the rail 41 encased in the channel 28 of the backrest and consequently, the secondary bow 66 is deflected downwardly and acts against the bevelled contact formation 615 on the F-shaped head 612 thereby deforming the auxiliary bow section. This second mode of resilient deformation further enhances the restoring force exerted by the finger 69. In the case of the tilt limiter shown in FIG. 6*c*, the auxiliary bow 611 deforms along with the primary and secondary bows.

Simultaneously, there is a progressive reduction of the initial rotating force as the centre of mass of the combined seat member and counter-weight approaches the lowermost point of rotation, beneath the hinge axis. Eventually the two opposing forces will be in equilibrium and notwithstanding any drag or overshoot in the system, a steady state will be reached, corresponding to the intermediate position of the seat member.

Put another way, the seat will be stationary and in the intermediate position when the moments around the hinge axis created by the counterweight and the tilt-limiter are equal.

During this process, it is possible that the F-shaped head 612 may be thrust beyond the front opening 213 of the housing, as shown in FIG. 12*b*. Should this occur, the bevelled edges on the contact formation, guide the head back into the housing and prevent it from catching on the housing entrance.

It will be appreciated that the dimensions of the seat, the mass of the seat member, the mass of the counter-weight, and the configuration of the tilt limiter will independently affect the angle of tilt of the seat member in the intermediate position. Therefore, by providing a number of different configurations of tilt-limiter, the angle of inclination of the seat member in the intermediate position may be infinitely adjusted without changing the configuration of the more substantial parts of the assembly. For instance, referring to drawings, it can be seen that the tilt-limiter shown in FIG. 6*b* has a more extended, straighter finger portion than that of the tilt-limiter shown in FIG. 6*a*. As a result, when assembled in the seat assembly, the straighter finger of the tilt-limiter shown in FIG. 6*b* will engage the contact surface on the seat member at a higher angle of tilt than that of the more curved finger shown in FIG. 6*a*. Accordingly, the seat member in the former example will assume a correspondingly higher angle of tilt in the intermediate position. This can be seen in FIGS. 12*a* and 11*a* respectively.

In this embodiment all the seat components are injection moulded from a plastics material. The material can be coloured as required and may include additives to combat the effects of degradation due to exposure to sunlight and precipitation. In addition, the seat may include a form of padding on either the backrest or seat member to enhance user comfort. This padding may be foam rubber or similar deformable material or the seat may be upholstered including cushioning or inner springs as are commonly used in bedding and other furniture.

It will be readily appreciated that numerous substitutions, variations and modifications may be made by those skilled in the art without departing from the essential spirit and scope of the invention. For instance, while in the present embodiment the back rest is mounted to a frame in an alternative embodiment, the back-rest may be bolted, welded clipped or otherwise attached directly to the supporting structure. The support may be a frame, mounting bracket, wall or substrate. In addition, the seat member and backrest may be independently mounted to frames or other supporting structures, rather than being anchored to the same supporting component. In yet another embodiment, the backrest is secured to the support structure and the seat member is rotatably mounted directly to the backrest.

In yet another embodiment, the backrest may include any number of horizontally extending arms, having any combination of channels, housings or abutment surfaces. In that case, the seat member would provide corresponding formations to interact with the backrest and allow rotation and support where necessary. The channels and housings may be on top of, beside, adjacent or spaced from each other in separate or the same arms. They may also be accessed from the either the front or rear. In addition, tilt-limiter may be located on the seat member rather than the backrest. In a particular alternative embodiment, the tilt-limiter itself is integral with either the seat member or the backrest. There may also be more than one tilt limiter.

In another embodiment the counter-weight is replaced by a form a resilient biasing member which is adapted to return the seat member to the folded position. For example, this biasing member may be a coil, leaf or pneumatic spring attached to the seat and any suitable base or anchor point.

In further alternative embodiments, the invention may utilise any manner of pin or pivot mechanism known and used in the art as a means for providing a rotational hinge. For instance, bolts, expanding pins, bushes, rivets, or studs may all be used to similar effect. Likewise, the specific construction of the tilt limiter may be varied without materially departing from the scope of the invention. For instance, the tilt limiter may be moulded integrally with the seat member or backrest. In addition, the upper and lower arms may be formed as separate components.

The invention provides a seat assembly that is comfortable, convenient and safe for the occupant; allows greater access between seat rows for cleaning; is resistant to both intentional vandalism and normal operating wear and tear; and has few moving parts, which are simple to assemble and replace.

The seat combines the benefits of having two folded positions in the form of a fully folded position to provide maximum access around the seat and an intermediate position to provide safety and convenience for the occupant. Further, the angle of tilt of the intermediate position may be varied as required, by simple replacement or modification of the tilt-limiter.

The seat is simple to assemble. However, to thwart vandals, it is designed to be difficult to disassemble without special tools. The seat components are securely mounted to reduce any part of the seat being removed either inadvertently or without authorisation, and the hinges and tilt limiter are disposed underneath the seat to limit access.

The components are also designed to undergo many cycles of operation and withstand the effects of sun, rain and adverse environmental influences generally, thus providing a long service life. Should replacement of any of the parts be necessary, the seat may be simply disassembled with special tools and the appropriate parts readily replaced. In addition, since the seat only has a small number of parts, the size of any maintenance inventory need only be comparatively small.

In all these respects, the invention represents practical and commercially significant improvement over the prior art.

Although the invention has been described with reference to specific examples it will be appreciated by those skilled in the art that the invention may be embodied in many other forms.

What is claimed is:

1. A tip-up seat assembly comprising:

a backrest, adapted to be secured to a supporting structure in a generally upright orientation;

a corresponding seat member adjacent the backrest, hingedly mounted for rotation between an open position wherein the seat member is substantially horizontal and a folded position wherein the seat member is tilted upwardly toward the backrest;

bias means for biasing the seat member toward the folded position; and a tilt-limiter configured to resiliently restrain the seat member in an intermediate position, when unoccupied, thereby avoiding inadvertent rotation of the seat member into the folded position.

2. An assembly according to claim 1 wherein the tilt limiter is configured to provide a predetermined tilt angle of the seat member in the intermediate position.

3. An assembly according to claim 1, wherein the tilt limiter includes a resilient finger portion for engaging a first contact surface, the finger resiliently deforming when the seat member is tilted upwardly past the intermediate position, and thereby exerting a biasing force on the first contact surface to urge the seat member toward the intermediate position.

4. An assembly according to claim 1 wherein the tilt limiter is formed in one piece having upper and lower arms.

5. An assembly according to claim 4 wherein the arms extend from a generally V-shaped nose portion.

6. An assembly according to claim 4, wherein the upper arm includes a resilient finger.

7. An assembly according to claim 4, wherein the finger includes a bowed section to enhance the resiliency of the finger.

8. An assembly according to claim 7, wherein the bowed section has primary and secondary bows.

9. An assembly according to claims 4, wherein the lower arm includes a resilient auxiliary bowed section and a free end for engaging a second contact surface when the seat member is in the open position, thereby deforming the auxiliary bow to provide an initializing force to begin upward rotation of the seat member from the open position.

10. An assembly according to claim 9, wherein the free end is generally "F"-shaped.

11. An assembly according to claim 4, wherein the upper arm branches into a resilient finger and a flipper, the lower arm extending to join the upper arm adjacent the base of the flipper, the flipper being adapted to engage a second contact surface when the seat member is in the open position, thereby deforming the flipper to provide an initializing force to begin upward rotation of the seat member.

12. An assembly according to claim 1, wherein the tilt limiter is mounted in a housing.

13. An assembly according to claim 12, wherein the tilt-limiter includes a latch and stop formations for engaging corresponding snap locking formations on the housing, thereby to secure the tilt-limiter to the housing.

14. An assembly according to claim 1, wherein the tilt limiter is interchangeable with alternative tilt limiters of different shape or configuration, thereby allowing variation in the angle of inclination of the seat member in the intermediate position.

15. An assembly according to claim 1, wherein the tilt limiter is disposed on the backrest and the first and second contact surfaces are formed on the seat member.

16. An assembly according to claim 1, wherein the tilt limiter is disposed on the seat member and the first and second contact surfaces are formed on the backrest.

17. An assembly according to claim 1, wherein the biasing means include a counterweight located on the seat member.

* * * * *